US010801517B2

(12) United States Patent
Wang

(10) Patent No.: US 10,801,517 B2
(45) Date of Patent: Oct. 13, 2020

(54) BLOWER HOUSING

(71) Applicant: Ming-Chih Wang, Taichung (TW)

(72) Inventor: Ming-Chih Wang, Taichung (TW)

( * ) Notice: Subject to any disclaimer, the term of this patent is extended or adjusted under 35 U.S.C. 154(b) by 75 days.

(21) Appl. No.: 16/204,452

(22) Filed: Nov. 29, 2018

(65) Prior Publication Data

US 2020/0173459 A1 Jun. 4, 2020

(51) Int. Cl.
*F04D 29/42* (2006.01)

(52) U.S. Cl.
CPC ..... *F04D 29/4226* (2013.01)

(58) Field of Classification Search
CPC ..... F04D 29/4226
See application file for complete search history.

(56) References Cited

U.S. PATENT DOCUMENTS 1,584,944 A * 5/1926 Johnson ..... F04D 29/4226 415/213.1
1,873,386 A * 8/1932 Goldthwaite ..... F04D 29/4226 415/214.1
5,443,364 A * 8/1995 Mistry ..... F04D 29/626 403/326
5,954,476 A * 9/1999 Stewart ..... F04D 29/083 403/334
2004/0191052 A1* 9/2004 King ..... F04D 25/082 415/1
2009/0162226 A1* 6/2009 Campbell ..... F04D 29/4226 417/423.14

* cited by examiner

*Primary Examiner* — Ninh H. Nguyen
(74) *Attorney, Agent, or Firm* — Muncy, Geissler, Olds & Lowe, P.C.

(57) ABSTRACT

A blower housing is provided, including: two housing bodies and a positioning mechanism. Each of the two housing bodies includes a peripheral flange extending annularly. Two said peripheral flanges are detachably attached to and peripherally abutted against each other. One of the two said peripheral flanges has a lip protruding laterally therefrom, and the other of the two said peripheral flanges is at least partially overlapped with the lip. The positioning mechanism includes a first positioning portion which is disposed on one of the two housing bodies, and the first positioning portion is configured to be embeddedly engaged with a base.

11 Claims, 7 Drawing Sheets

BLOWER HOUSING

BACKGROUND OF THE INVENTION

Field of the Invention

The present invention relates to a blower housing.

Description of the Prior Art

A conventional blower housing includes two housing bodies which are connected with each other by a plurality of fasteners. However, the conventional blower housing usually has low working efficiency due to poor airtight effect. In addition, the conventional blower housing is nonadjustably fixedly connected or made in one piece with a stand so that an opening direction of a gas outlet is unchangeable, which results in inconvenience in use.

The present invention is, therefore, arisen to obviate or at least mitigate the above-mentioned disadvantages.

SUMMARY OF THE INVENTION

The main object of the present invention is to provide a blower housing which has preferable airtight effect.

To achieve the above and other objects, the present invention provides a blower housing, including: two housing bodies and a positioning mechanism. Each of the two housing bodies includes a peripheral flange extending annularly. Two said peripheral flanges are detachably attached to and peripherally abutted against each other. One of the two said peripheral flanges has a lip protruding laterally therefrom, and the other of the two said peripheral flanges is at least partially overlapped with the lip. The positioning mechanism includes a first positioning portion which is disposed on one of the two housing bodies, and the first positioning portion is configured to be embeddedly engaged with a base.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
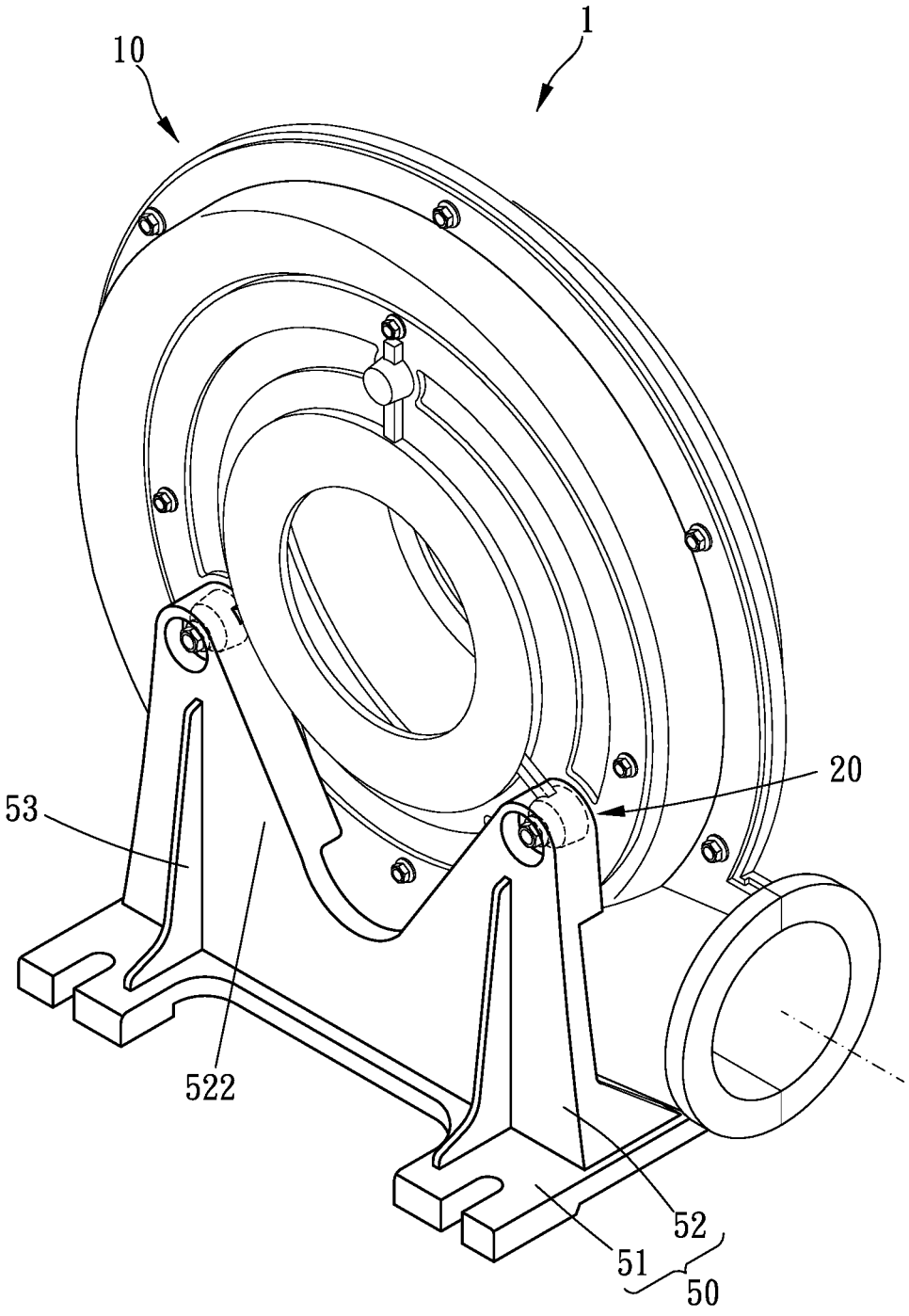
FIG. 1 is a stereogram of a preferable embodiment of the present invention.
Figure 2:
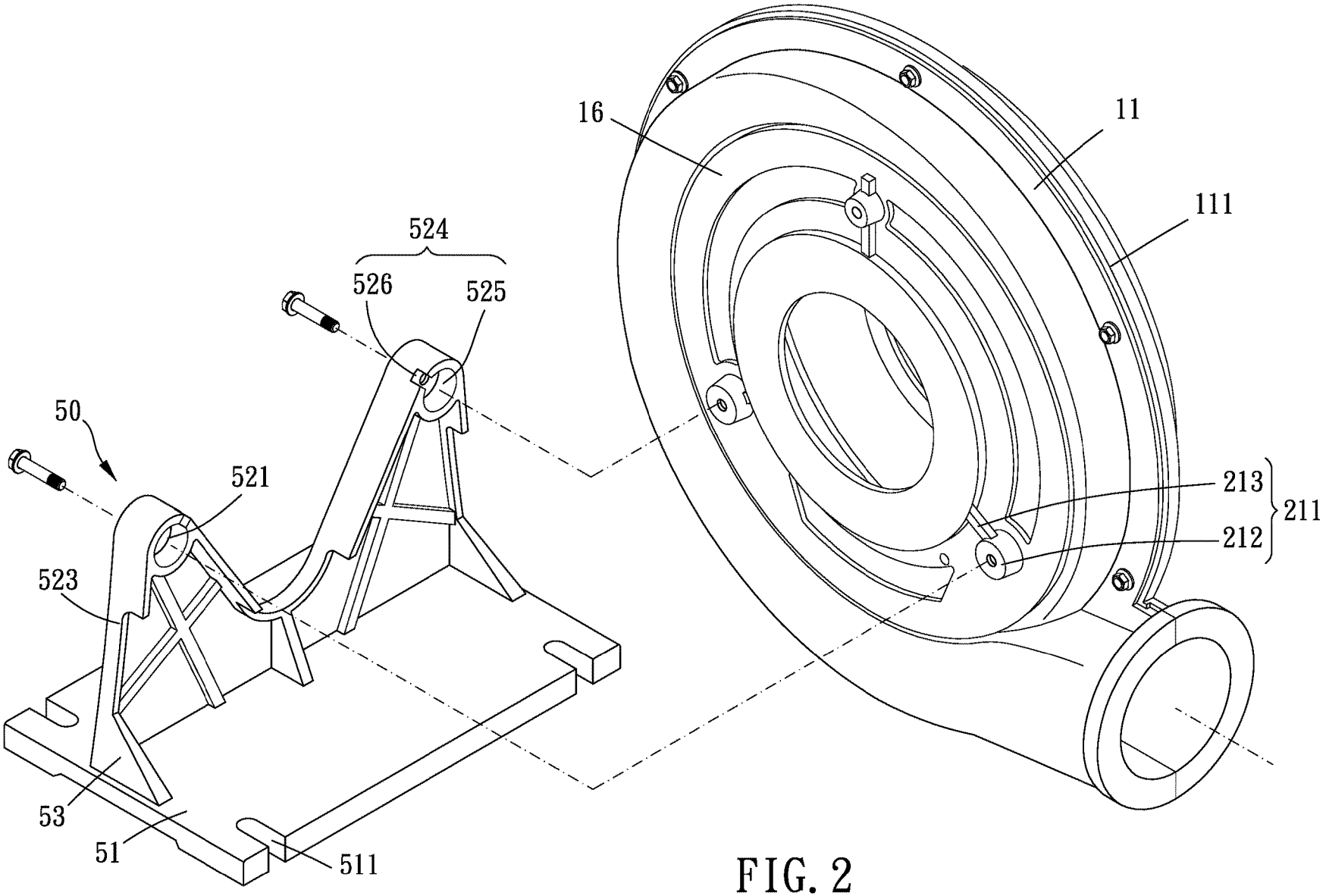
FIG. 2 is an assembly schematic diagram of a preferable embodiment of the present invention.
Figure 3:
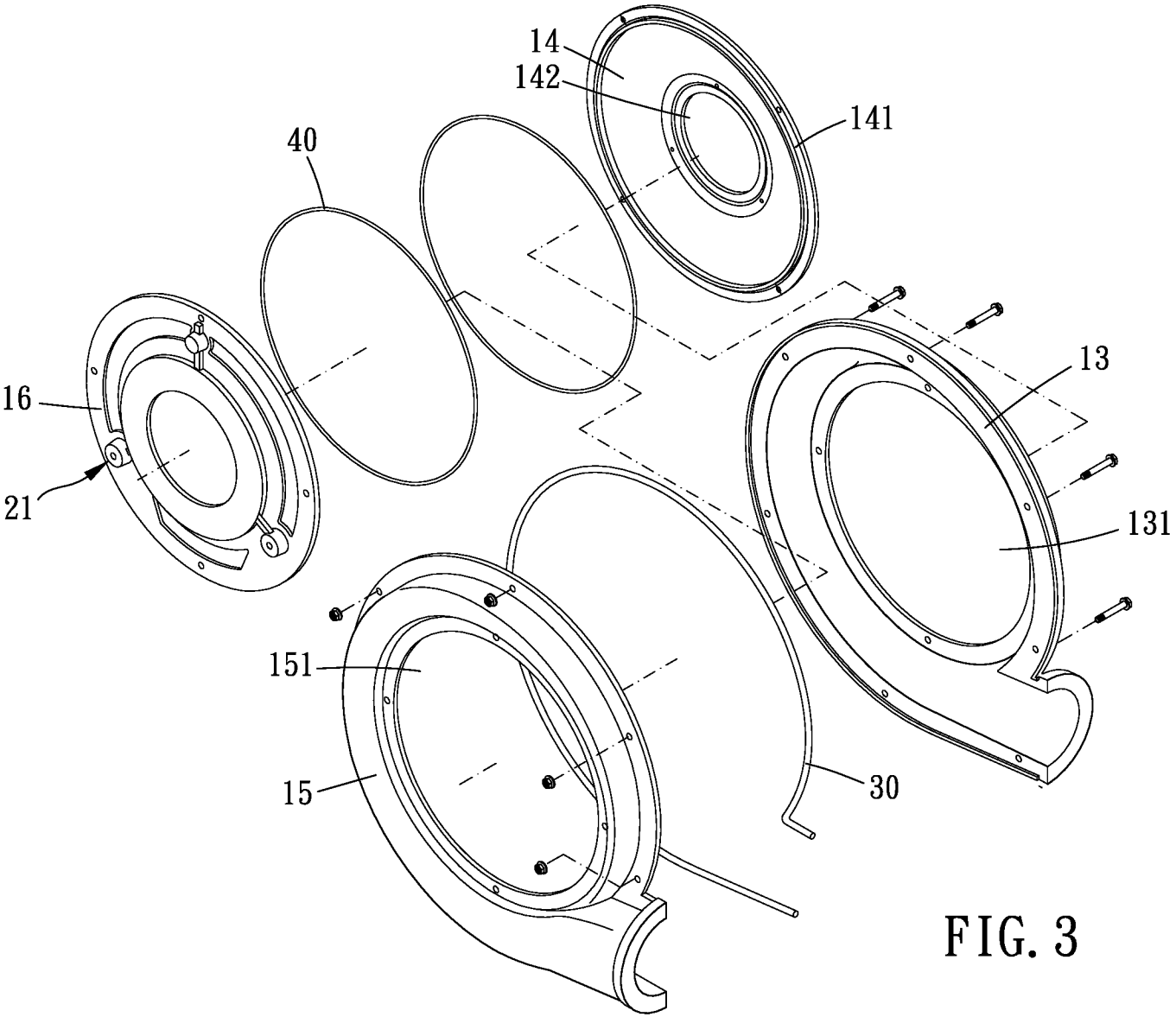
FIG. 3 is a breakdown drawing of a preferable embodiment of the present invention.
Figure 4:
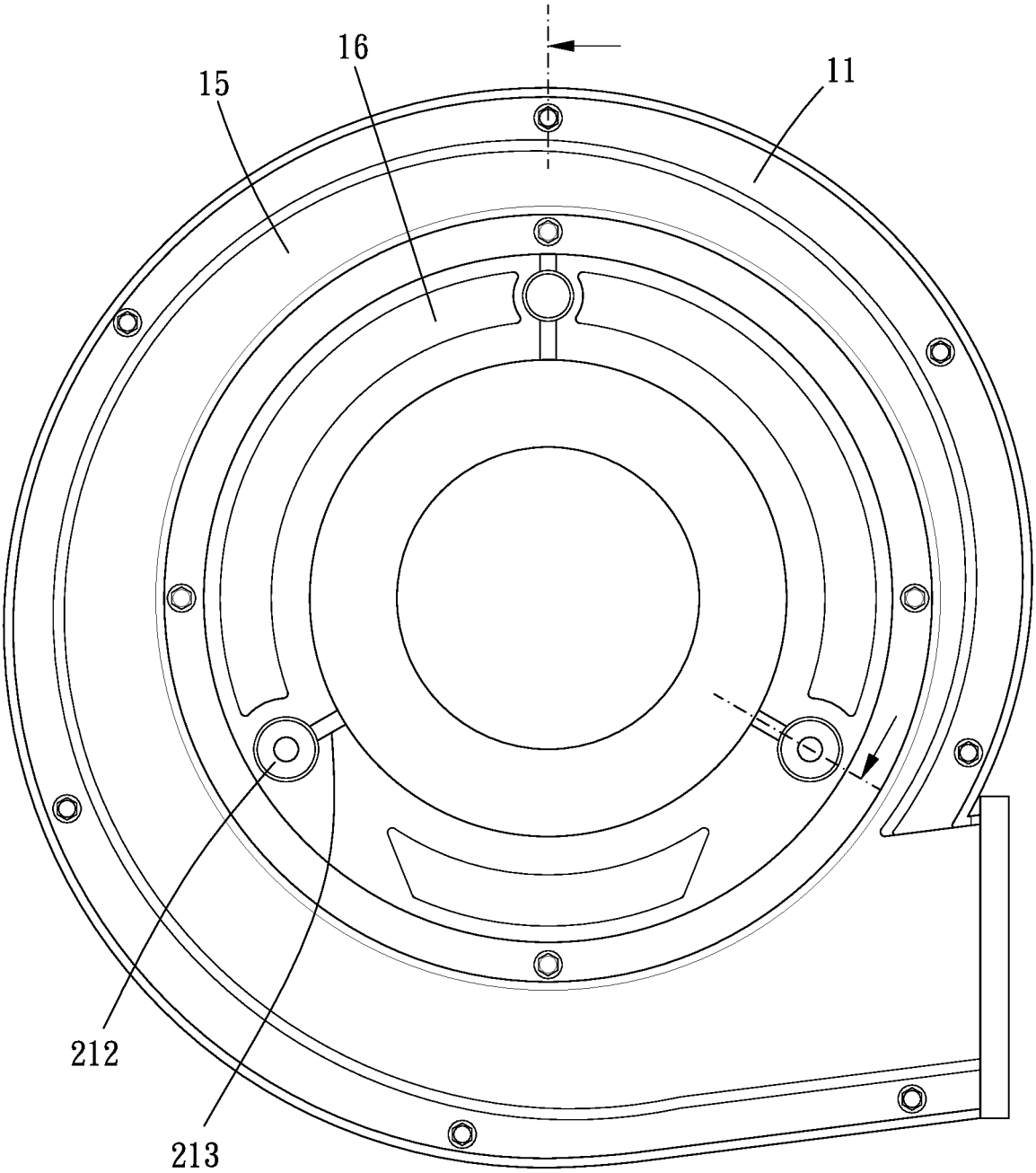
FIG. 4 is a side view of a preferable embodiment of the present invention.
Figure 5:
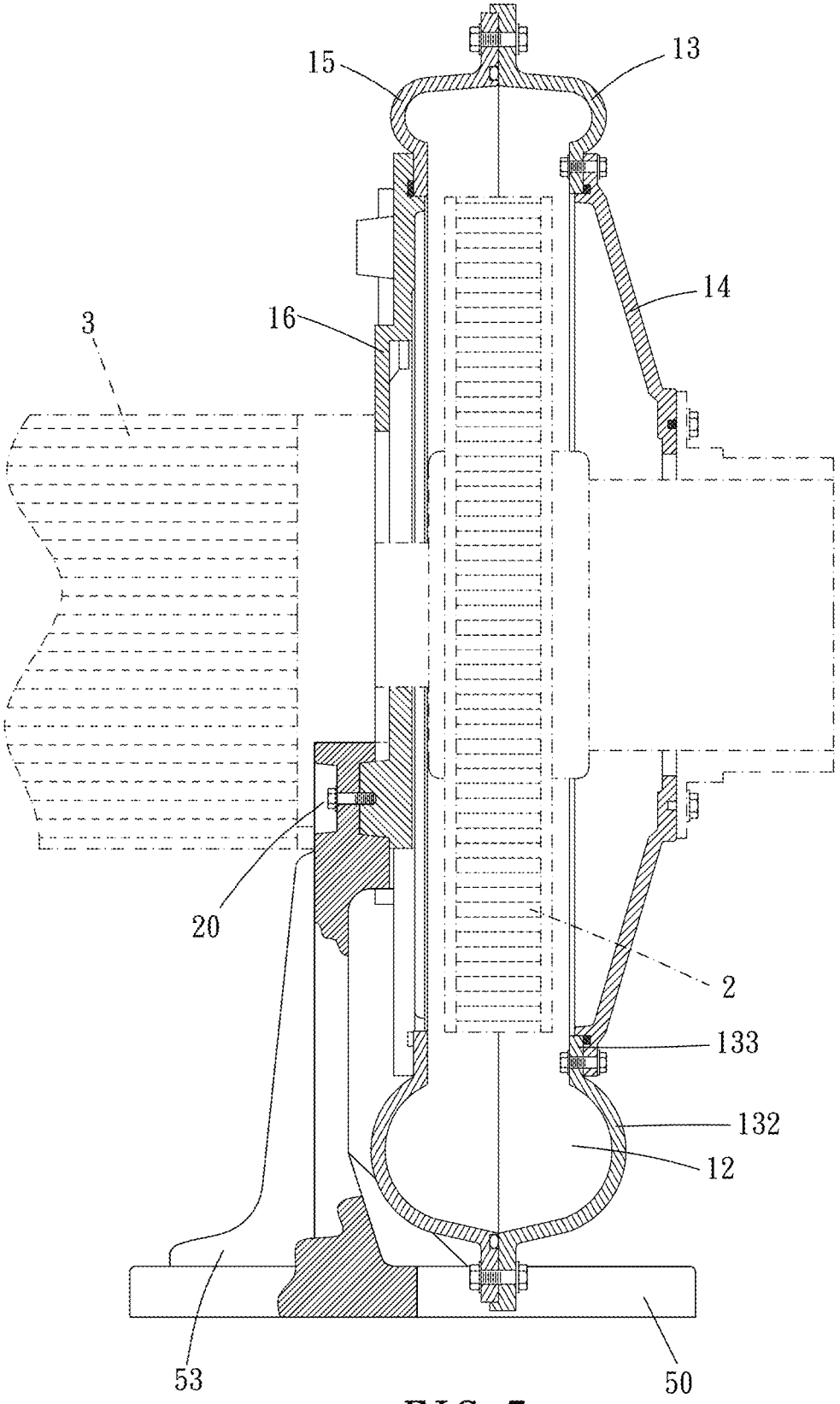
FIG. 5 is a partial cross-sectional view of a preferable embodiment of the present invention.
Figure 6:
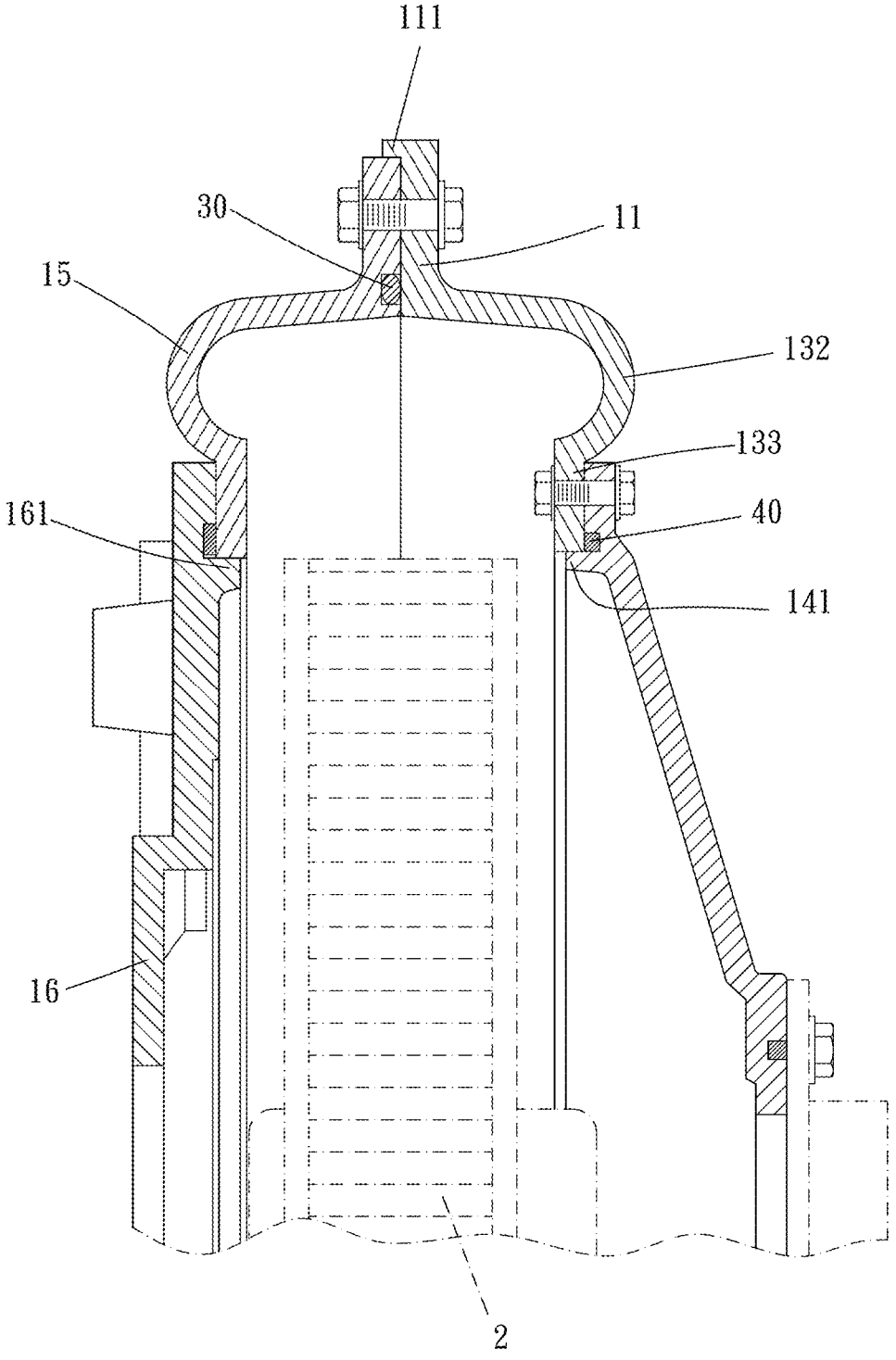
FIGS. 6 and 7 are partial enlargements of FIG. 5.
Figure 7:
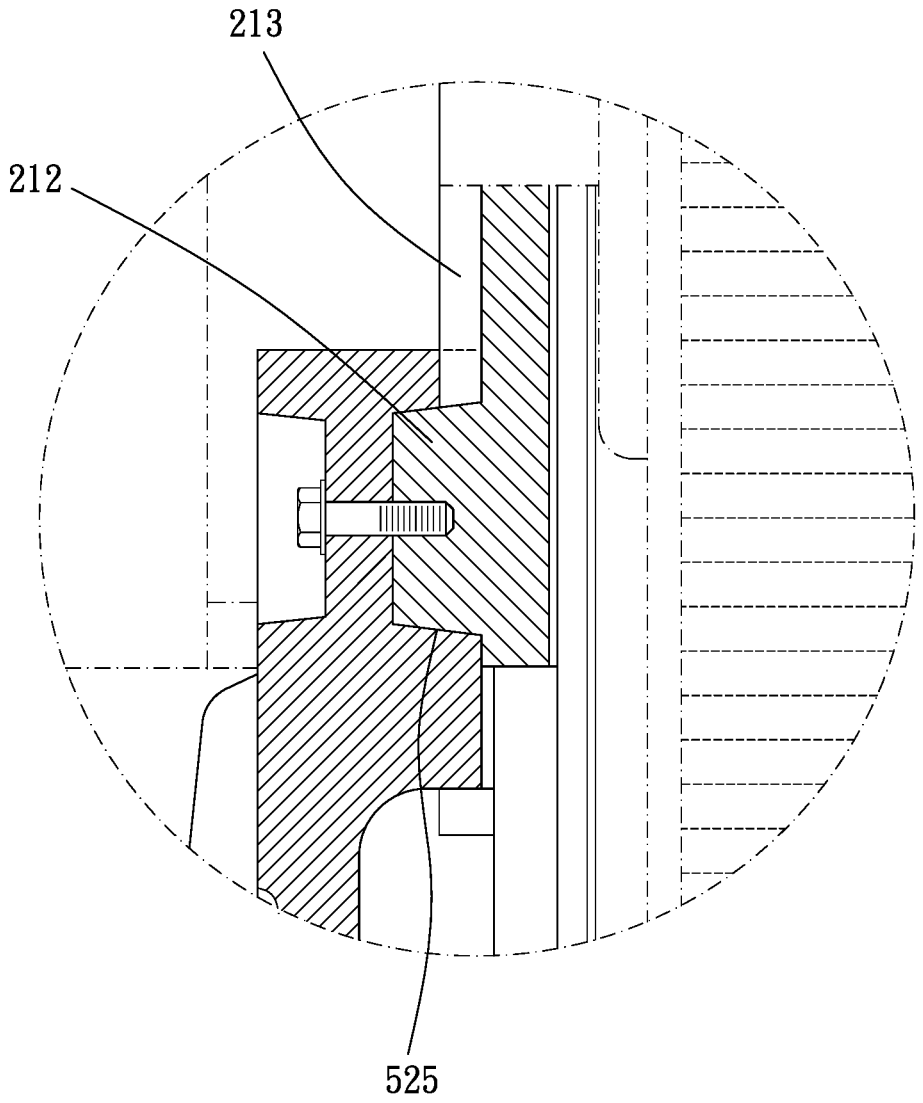

Please refer to FIGS. 1 to 7 for a preferable embodiment of the present invention. A blower housing 1 of the present invention includes two housing bodies 10 and a positioning mechanism 20.

Each of the two housing bodies 10 includes a peripheral flange 11 extending annularly. Two said peripheral flanges

11 are detachably attached to and peripherally abutted against each other. One of the two said peripheral flanges 11 has a lip 111 protruding laterally therefrom, and the other of the two said peripheral flanges 11 is at least partially overlapped with the lip 111. The positioning mechanism 20 includes a first positioning portion 21 which is disposed on one of the two housing bodies 10, and the first positioning portion 21 is configured to be embeddedly engaged with a base. Therefore, the blower housing 1 has preferable airtight effect. In this embodiment, the lip 111 is abutted against a circumferential wall of the peripheral flange 11 without the lip 111. The lip may be located between the two said peripheral flanges and engaged within one of the two said peripheral flanges.

Preferably, the blower housing 1 further includes a sealing member 30 which is disposed between the two peripheral flanges 11 so as to improve airtight effect. The two housing bodies 10 define an inner space 12 configured to receive an impeller 2. One of the two housing bodies 10 further includes a first ring wall 13 which includes a first opening 131 and a first sidewall 14 which is detachably connected to the first ring wall 13 and covers the first opening 131. The first sidewall 14 further includes an annular projection 141 extending laterally, and the annular projection 141 is disposed annularly within the first opening 131 (preferably radially abutted annularly against the first ring wall 13) so that the first sidewall 14 are radially restricted by the first ring wall 13 for easy assembly and good airtight. The first sidewall 14 includes a gas inlet 142 which is communicated with the inner space 12. Preferably, the first sidewall 14 is tapered toward the gas inlet 142, which provides larger airflow space and diversion effect. The first ring wall 13 further includes a convex portion 132 protruding axially away from the inner space 12 and an assembling flange 133 extending laterally from the convex portion 132 and defining the first opening 131. The convex portion 132 protrudes axially beyond the assembling flange 133, and the first sidewall 14 is connected with the assembling flange 133 so that the first sidewall 14 is radially restricted by the convex portion 132 and not easily displaced during assembling.

The other of the two housing bodies 10 further includes a second ring wall 15 which includes a second opening 151 and a second sidewall 16 which is detachably connected to the second ring wall 15 and covers the second opening 151, and the first positioning portion 21 is integrally formed as a part of the second sidewall 16. The second sidewall 16 further includes an annular projection 161 extending laterally, and the annular projection 161 is disposed annularly within the second opening 151 (preferably radially abutted annularly against the second ring wall 15) so that the second sidewall 16 is radially restricted by the second ring wall 15 for easy assembly and good airtight. The second sidewall 16 is connectable with a motor 3 which is configured to drive the impeller 2.

In this embodiment, the first sidewall 14 and the second sidewall 16 are respectively connected to the first ring wall 13 and the second ring wall 15 by a plurality of fasteners, which is convenient for assembly and maintenance. However, the first sidewall and the second sidewall may be mounted to or integrally made in one piece with the first ring wall and the second ring wall respectively.

The blower housing 1 further includes two O-rings 40, one of the two O-rings 40 is disposed between the first sidewall 14 and the first ring wall 13, and the other of the two O-rings 40 is disposed between the second sidewall 16 and the second ring wall 15. Therefore, the blower housing 1 has better airtight effect.

The blower housing 1 further includes a pedestal 50, wherein the pedestal 50 includes a base portion 51 and a supporting portion 52 connected with the base portion 51. The supporting portion 52 includes a second positioning portion 521 which is correspondingly embeddedly engaged respectively with the first positioning portion 21 so that the blower housing 1 can be positionably assembled to the pedestal 50. The second positioning portion 521 is integrally formed as a part of the supporting portion 52 which can increase structural strength. In operation, the second sidewall 16 is assembled to the pedestal 50 and then the two housing bodies 10 are assembled with the second sidewall 16, and a direction of a gas outlet of the blower housing 1 is adjustable according to various requirements. The supporting portion 52 has a U-shaped bracket 522 opposite to the base portion 51, the bracket 522 includes two supporting arms 523 and the second positioning portion 521 is disposed on the two supporting arms 523 which can disperse weights of the two housing bodies 10, the impeller 2 and the motor 3 and increase durability of the bracket 522.

One of the first positioning portion 21 and the second positioning portion 521 is a protruding portion, and the other is a concave portion. In this embodiment, the protruding portion includes at least two protruding members 211, and each of the at least two protruding members 211 includes a block 212 and a rib 213 extending laterally from the block 212. The concave portion includes at least two concave members 524, and each of the concave members 524 includes a receiving groove 525 and a notch 526 extending laterally from the receiving groove 525. The block 212 and the rib 213 correspond respectively to the receiving groove 525 and the notch 526 so that each of the at least two protruding members 211 can be engaged with one of the at least two concave members 524 more stably.

The pedestal 50 further includes a plurality of supporting ribs 53 which are disposed between the base portion 51 and the supporting portion 52 so as to increase supporting strength. The base portion 51 has a plurality of slots 511 which extend outwardly and are open circumferentially, and each of the slots 511 is configured for a fastener to be penetrated therethrough and connect the pedestal 50 to a base.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A blower housing, including:

two housing bodies, each of the two housing bodies including a peripheral flange extending annularly and laterally, two said peripheral flanges being detachably attached to and peripherally abutted against each other, one of the two said peripheral flanges having a lip protruding laterally therefrom, and the other of the two said peripheral flanges being at least partially overlapped with the lip;

a positioning mechanism, including a first positioning portion which is disposed on one of the two housing bodies, the first positioning portion configured to be embeddedly engaged with a base, wherein the two housing bodies define an inner space, one of the two housing bodies further includes a first ring wall which includes a first opening and a first sidewall which is detachably connected to the first ring wall and covers the first opening, the first sidewall includes a gas inlet which is communicated with the inner space;

wherein the first sidewall further includes an annular projection extending laterally, and the annular projection is disposed annularly within the first opening and is radially abuttable against the first ring wall.

2. The blower housing of claim 1, further including a sealing member which is disposed between the two peripheral flanges.

3. The blower housing of claim 1, wherein the first sidewall is tapered toward the gas inlet the first ring wall further includes a convex portion protruding axially away from the inner space and an assembling flange extending laterally from the convex portion and defining the first opening, the convex portion protrudes axially beyond the assembling flange, and the first sidewall is connected with the assembling flange.

4. The blower housing of claim 1, wherein one of the two housing bodies further includes a second ring wall which includes a second opening and a second sidewall which is detachably connected to the second ring wall and covers the second opening, and the first positioning portion is integrally formed as a part of the second sidewall.

5. The blower housing of claim 4, wherein the second sidewall further includes an annular projection extending laterally, and the annular projection is disposed annularly within the second opening.

6. The blower housing of claim 1, further including a pedestal, wherein the pedestal includes a base portion and a supporting portion connected with the base portion, the supporting portion includes a second positioning portion which is correspondingly embeddedly engaged respectively with the first positioning portion.

7. The blower housing of claim 6, wherein the second positioning portion is integrally formed as a part of the supporting portion.

8. The blower housing of claim 6, wherein one of the first positioning portion and the second positioning portion is a protruding portion, and the other is a concave portion.

9. The blower housing of claim 8, wherein the protruding portion includes at least two protruding members, each of the at least two protruding members includes a block and a rib extending laterally from the block, the concave portion includes at least two concave members, each of the concave members includes a receiving groove and a notch extending laterally from the receiving groove, and the block and the rib correspond to the receiving groove and the notch respectively.

10. The blower housing of claim 9, further including a sealing member which is disposed between the two peripheral flanges; the first sidewall is tapered toward the gas inlet; the other of the two housing bodies further includes a second ring wall which includes a second opening and a second sidewall which is detachably connected to the second ring wall and covers the second opening, and the first positioning portion is integrally formed as a part of the second sidewall; the second sidewall further includes an annular projection extending laterally, and the annular projection is disposed annularly within the second opening; the second positioning portion is integrally formed as a part of the supporting portion; the blower housing further includes two O-rings, one of the two O-rings is disposed between the first sidewall and the first ring wall, and the other of the two O-rings is disposed between the second sidewall and the second ring wall; the supporting portion has an U-shaped bracket opposite to the base portion, the bracket includes two supporting arms and the second positioning portion is disposed on the two supporting arms; the pedestal further includes a plurality of supporting ribs which are disposed between the base portion and the supporting portion; the base portion has a plurality of slots which extend outwardly and are open circumferentially.

11. The blower housing of claim 6, wherein the supporting portion has an U-shaped bracket opposite to the base portion, the bracket includes two supporting arms and the second positioning portion is disposed on the two supporting arms.

* * * * *